US009997097B2

(12) United States Patent
Chen et al.

(10) Patent No.: US 9,997,097 B2
(45) Date of Patent: Jun. 12, 2018

(54) GAMMA REFERENCE VOLTAGE GENERATING DEVICE AND DISPLAY WITH TEMPERATURE COMPENSATION

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Huijuan Chen, Beijing (CN); Hyungkyu Kim, Beijing (CN); Qian Wang, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 254 days.

(21) Appl. No.: 14/422,324

(22) PCT Filed: Jul. 25, 2014

(86) PCT No.: PCT/CN2014/083062
§ 371 (c)(1),
(2) Date: Feb. 18, 2015

(87) PCT Pub. No.: WO2015/109801
PCT Pub. Date: Jul. 30, 2015

(65) Prior Publication Data

US 2016/0012763 A1 Jan. 14, 2016

(30) Foreign Application Priority Data

Jan. 27, 2014 (CN) ..... 2014 1 0040246

(51) Int. Cl.
*G09G 3/36* (2006.01)
*G09G 3/20* (2006.01)

(52) U.S. Cl.
CPC ..... *G09G 3/2011* (2013.01); *G09G 3/3648* (2013.01); *G09G 3/3696* (2013.01);
(Continued)

(58) Field of Classification Search
CPC ..... G09G 3/3696; G09G 2330/028; G09G 2320/0252; G09G 2320/0276; G09G 2320/041; G09G 2320/0673
See application file for complete search history.

(56) References Cited

U.S. PATENT DOCUMENTS 5,228,102 A * 7/1993 Sato ..... G02B 6/2551 219/385
6,545,523 B1 * 4/2003 Takami ..... A61B 1/00039 327/378
(Continued)

FOREIGN PATENT DOCUMENTS

CN 1954353 A 4/2007
CN 101022005 A 8/2007
(Continued)

OTHER PUBLICATIONS

Second Chinese Office Action in Chinese Application No. 201410040246.1, dated Dec. 7, 2015 with English translation.
(Continued)

*Primary Examiner* — Ram Mistry
(74) *Attorney, Agent, or Firm* — Collard & Roe, P.C.

(57) ABSTRACT

Provided are a Gamma reference voltage generating device and a display. The Gamma reference voltage generating device comprises a Gamma reference voltage source and a Gamma reference voltage converting module, the Gamma reference voltage source being connected to the Gamma reference voltage converting module and configured to provide Gamma reference voltages, wherein the Gamma reference voltage generating device further comprises at
(Continued)

least one temperature compensation circuit which is connected to the Gamma reference voltage converting module and configured to automatically adjust output voltages according to temperature change to compensate the Gamma reference voltages output by the Gamma reference voltage source through the Gamma reference voltage converting module. The display comprises the above Gamma reference voltage generating device, and thus can avoid poor display due to temperature influences.

18 Claims, 5 Drawing Sheets

(52) U.S. Cl.
CPC ..... *G09G 2320/0252* (2013.01); *G09G 2320/041* (2013.01); *G09G 2320/0673* (2013.01); *G09G 2330/12* (2013.01)

(56) References Cited

U.S. PATENT DOCUMENTS

| | | | | |
|---|---|---|---|---|
| 7,639,222 | B2 * | 12/2009 | Chen | G09G 3/3685 345/101 |
| 8,068,086 | B2 | 11/2011 | Moon | |
| 9,268,419 | B2 * | 2/2016 | Liao | G06F 3/038 |
| 2002/0145581 | A1 * | 10/2002 | Kudo | G09G 3/3685 345/89 |
| 2002/0186230 | A1 * | 12/2002 | Kudo | G09G 3/3607 345/690 |
| 2004/0196233 | A1 | 10/2004 | Shimizu | |
| 2005/0007393 | A1 * | 1/2005 | Akai | G09G 3/3233 345/690 |
| 2006/0164354 | A1 * | 7/2006 | Lee | G02F 1/136213 345/89 |
| 2007/0057314 | A1 * | 3/2007 | Natori | G11C 16/0416 257/315 |
| 2007/0262972 | A1 * | 11/2007 | Nakata | G09G 3/3696 345/204 |
| 2008/0186263 | A1 * | 8/2008 | Lee | G09G 3/3225 345/82 |
| 2011/0050676 | A1 * | 3/2011 | Lee | G09G 3/3233 345/212 |
| 2011/0279440 | A1 * | 11/2011 | Lin | G09G 3/3688 345/212 |
| 2013/0249881 | A1 | 9/2013 | Chae et al. | |

FOREIGN PATENT DOCUMENTS

| | | | |
|---|---|---|---|
| CN | 101320545 | A | 12/2008 |
| CN | 201327703 | Y | 10/2009 |
| CN | 102222485 | A | 10/2011 |
| CN | 102543021 | A | 7/2012 |
| CN | 202601142 | U | 12/2012 |
| CN | 103366673 | A | 10/2013 |
| CN | 103794187 | A | 5/2014 |
| KR | 10-2006-0000973 | A | 1/2006 |

OTHER PUBLICATIONS

English translation of the International Preliminary Report on Patentability and Written Opinion of the International Searching Authority of PCT/CN2014/083062, dated Aug. 2, 2016.

Chinese Office Action of Chinese Application No. 201410040246.1, dated Jul. 2, 2015 with English translation.

International Search Report and Written Opinion of the International Searching Authority with Notice of Transmittal of the International Search Report and Written Opinion of PCT/CN2014/083062 in Chinese, dated Oct. 29, 2014

* cited by examiner

GAMMA REFERENCE VOLTAGE GENERATING DEVICE AND DISPLAY WITH TEMPERATURE COMPENSATION

CROSS REFERENCE TO RELATED APPLICATIONS

This application is the National Stage of PCT/CN2014/083062 filed on Jul. 25, 2014, which claims priority under 35 U.S.C. § 119 of Chinese Application No. 201410040246.1 filed on Jan. 27, 2014, the disclosure of which is incorporated by reference.

TECHNICAL FIELD OF THE DISCLOSURE

The present disclosure relates to a Gamma reference voltage generating device and a display.

BACKGROUND

Currently, the driving voltage of a TFT-LCD (Thin Film Transistor-Liquid Crystal Display) is a fixed value which is usually AVDD. A source driver IC finally forms gray scale voltages by performing computation on the driving voltage (AVDD), a common voltage (VCOM) and Gamma voltages, in order for the TFT-LCD to realize display of different gray scales. When the environment temperature of the TFT-LCD changes, deflection angles of the same gray scale voltage for liquid crystal (LC) molecules are different, resulting in change of the display brightness and the contrast of the TFT-LCD, which is reflected by the Gamma voltage values on the Gamma gray scale curve deviating from the design values. In particular, when the temperature drops, the LC viscosity increases, and if it is under the effect of the same driving voltage, the LC response time will be longer. Therefore, in order to deflect the LC molecules to the same angle as at the normal temperature, the electric field force required at this time will be increased, that is, larger gray scale voltage is needed. Therefore, with the change of temperature, the driving voltage of the TFT-LCD is correspondingly modified, to compensate for the temperature and alleviate the poor display caused by the temperature change.

Currently, the temperature compensation for the TFT-LCD is realized most by thermosensitive resistors or resistance temperature sensors. Such a method is realized specifically by using the linear relationship between the resistance of the resistor and the temperature change. However, in general, the response time of the LC molecules is not in linear relationship with the temperature change, that is, when the same gray scale is displayed, the electrical field force required by the LC is not in linear relationship with the temperature change. Therefore, it is not possible to realize good temperature compensation for the TFT-LCD by using thermosensitive resistors or resistance temperature sensors.

SUMMARY

In view of the above problems existing in known gray scale voltage generating devices, the present disclosure provides a Gamma reference voltage generating device and a display which can perform temperature compensation.

According to one aspect of the present disclosure, there is provided a Gamma reference voltage generating device comprising a Gamma reference voltage source and a Gamma reference voltage converting module, the Gamma reference voltage source being connected to the Gamma reference voltage converting module and configured to provide Gamma reference voltages, wherein the Gamma reference voltage generating device further comprises at least one temperature compensation circuit which is connected to the Gamma reference voltage converting module and configured to automatically adjust output voltages according to temperature change to compensate the Gamma reference voltages output by the Gamma reference voltage source through the Gamma reference voltage converting module.

In an exemplary embodiment, the temperature compensation circuit comprises a temperature sensing module, a selection output module and a first voltage source; the temperature sensing module is configured to convert a temperature signal into an electrical signal; the first voltage source is connected to the selection output module and configured to provide first voltage to the selection output module; and the selection output module is configured to select and output a compensation voltage from the first voltage input by the first voltage source according to the electrical signal from the temperature sensing module.

Further, in an exemplary embodiment, the selection output module comprises an analog-to-digital converting unit, a logic selection unit and a logic control unit; the analog-to-digital converting unit is configured to convert the electric signal from the temperature sensing module into a digital signal; the logic selection unit is configured to select the compensation voltage input to the logic control unit according to the digital signal from the analog-to-digital converting unit; and the logic control unit is configured to output stable compensation voltage to compensate the Gamma reference voltages.

Further, in an exemplary embodiment, the logic selection unit comprises a selector and a Rx resistor network; the Rx resistor network is connected to the first voltage source, and comprises a bleeder circuit consisting of n resistors connected in series and n switch units, one terminal of the $i^{th}$ switch unit is connected to a bleeder node of the $i^{th}$ resistor, and the other terminal of each switch unit is connected to the logic control unit, where i is larger than 1 but smaller than n; and the selector is configured to selectively turn on a switch unit of the Rx resistor network according to the digital signal output by the analog-to-digital converting unit.

Further, in an exemplary embodiment, the logic control unit comprises an adder and a negative feedback amplifier; a positive input terminal of the adder receives the signal output by the logic selection unit, and a negative input terminal of the adder is connected to the output terminal of the adder; and a positive input terminal of the negative feedback amplifier is connected to the output terminal of the adder, a negative input terminal of the negative feedback amplifier is grounded, and the output terminal of the feedback amplifier outputs a voltage signal which has been subjected to temperature compensation.

In an exemplary embodiment, the temperature sensing module comprises a temperature sensor and a temperature transmitter; and the temperature sensor is configured to sense temperature and transfer the temperature signal to the temperature transmitter, and the temperature transmitter converts the temperature signal into the electrical signal.

According to another aspect of the present disclosure, there is provided a display comprising the Gamma reference voltage generating device as described in the above and a gray scale voltage generating device connected thereto, wherein the gray scale voltage generating device is configured to generate a plurality of gray scale voltages based on the Gamma reference voltages which have been subjected to temperature compensation, and the display displays gray scales using the gray scale voltages.

In the Gamma reference voltage generating device according to the present disclosure, the device comprises a temperature compensation unit, the temperature sensing module of the temperature compensation unit senses temperature change, and a first source module adjusts the output voltages of the temperature compensation unit. Therefore, the temperature compensation unit outputs a corresponding temperature compensation voltage according to the temperature change, and inputs the output temperature compensation voltage into the Gamma voltage converting unit. At this time, the Gamma voltage converting unit outputs the compensated Gamma voltages through respective Gamma voltage signal ports. When the Gamma reference voltage generating device is applied to a gray scale voltage generating device, the Gamma voltages are compensated, and thus each gray scale voltages derived from the Gamma voltage are also compensated. Since the display according to the present disclosure comprises the above-described Gamma reference voltage generating device, it can avoid poor display due to temperature effect.

DETAILED DESCRIPTION

In order for those skilled in the art to better understand technical solutions of the present disclosure, specific implementations of the present disclosure will be further described in detail in connection with the figures.

Figure 1:
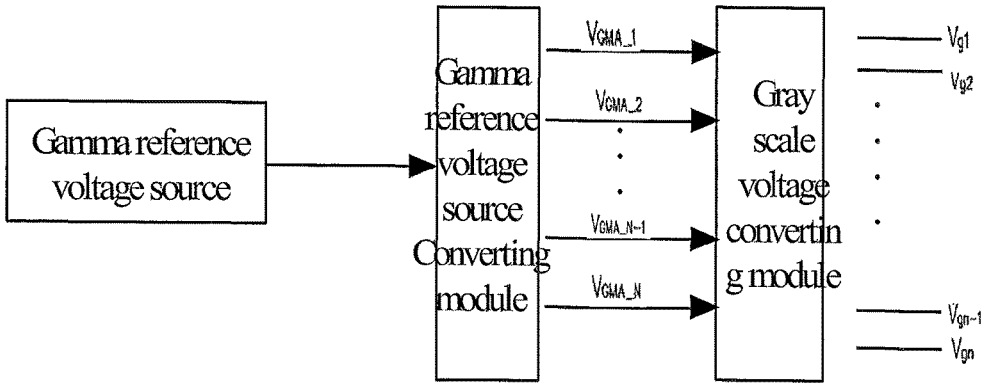
FIG. 1 is a schematic diagram of the basic principle of a known Gamma reference voltage generating device.
Figure 2:
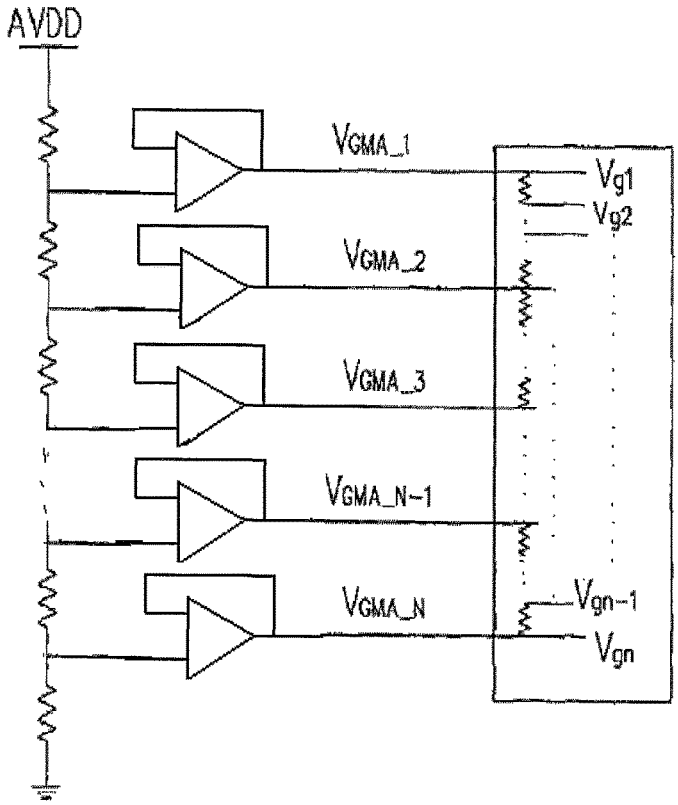
FIG. 2 is a schematic diagram of a basic circuit of a known Gamma reference voltage generating device.

FIG. 1 and FIG. 2 show schematic diagrams of a known Gamma reference voltage generating devices. As shown in FIG. 1 and FIG. 2, in the known Gamma reference voltage generating device, the Gamma reference voltage source provides voltage to the Gamma reference voltage converting module, and the voltage is converted to different Gamma reference voltages ($V_{GmA_1}$~$V_{GMA_N}$) by the Gamma reference voltage converting module. The Gamma reference voltages are output to the Gray scale voltage generating module through Gamma voltage signal ports, and finally generate gray scale voltages (Vg1~Vgn). Taking the 8 bit source driving IC as an example, totally 256 gray scale voltages will be generated, and correspondingly, there are 8 Gamma reference voltage ($V_{GmA_1}$~$V_{GMA_8}$) signal ports totally. The 8 Gamma reference voltages $V_{GmA_1}$~$V_{GMA_8}$ are output to the gray scale voltage generating module through the voltage signal ports to generate 256 gray scale voltages (Vg1~Vg256), in order to realize display of 256 gray scales.

First Embodiment

Figure 3:
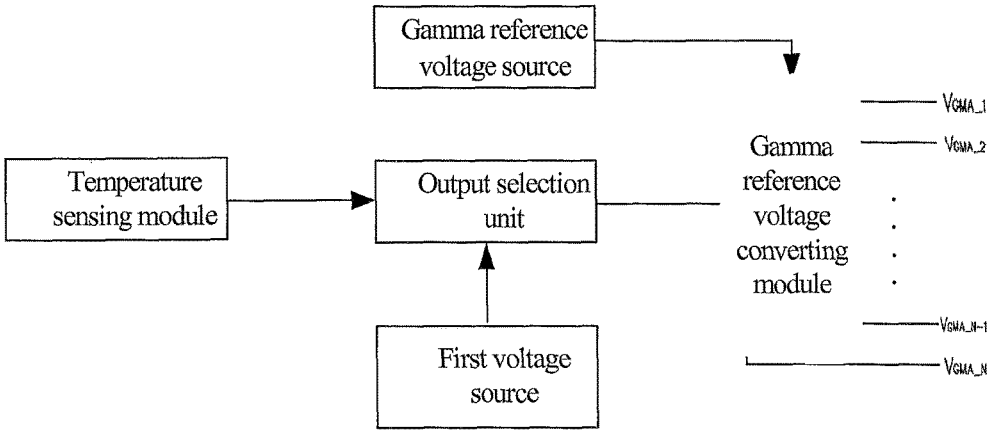
FIG. 3 is a schematic diagram of a circuit structure of a Gamma reference voltage generating device according to a first embodiment of the present disclosure.

FIG. 3 schematically illustrates a circuit structure of a Gamma reference voltage generating device according to a first embodiment of the present disclosure. As shown in FIG. 3, the Gamma reference voltage generating device in the embodiment comprises a Gamma reference voltage source and a Gamma reference voltage converting module. The Gamma reference voltage source is connected to the Gamma reference voltage converting module and configured to provide N Gamma reference voltages. The Gamma reference voltage generating device in the embodiment further comprises at least one temperature compensation circuit which is connected to the Gamma reference voltage converting module and configured to automatically adjust output voltages according to temperature change to compensate the Gamma reference voltages output by the Gamma reference voltage source through the Gamma reference voltage converting module.

The Gamma reference voltage converting module comprises N Gamma reference voltage signal ports which are corresponding to N Gamma reference voltages VGMA_1~VGMA_N. The Gamma reference voltage source is configured to provide voltage to the Gamma reference voltage converting module which converts the voltage provided by the Gamma reference voltage source into N Gamma reference voltages and provides them the Gamma reference voltage signal ports.

In the Gamma reference voltage generating device provided in the embodiment, the device comprises a temperature compensation unit which can automatically adjust the output voltages according to the temperature change td compensate the Gamma reference voltages output by the reference voltage converting module. When the Gamma reference voltage generating device is applied to a gray scale voltage generating device, the Gamma reference voltages are compensated for, and thus respective gray scale voltages derived from the Gamma reference voltage are also compensated. Thereby, poor display due to temperature change is alleviated.

For example, as shown in FIG. 3, the temperature compensation circuit of the present embodiment comprises a temperature sensing module, a selection output module and a first voltage source. The temperature sensing module is configured to convert a temperature signal into an electrical signal, and the temperature sensing module is connected to the selection output module. The first voltage source is connected to the selection output module and configured to provide first voltage to the selection output module. The selection output module is configured to select and output a compensation voltage from the first voltage input by the first voltage source according to the electrical signal from the temperature sensing module. That is, if the temperature is different, the compensation voltage output by the selection output module is different. The output voltage can be automatically adjusted according to the temperature change to compensate the Gamma reference voltages.

Second Embodiment

Figure 4:
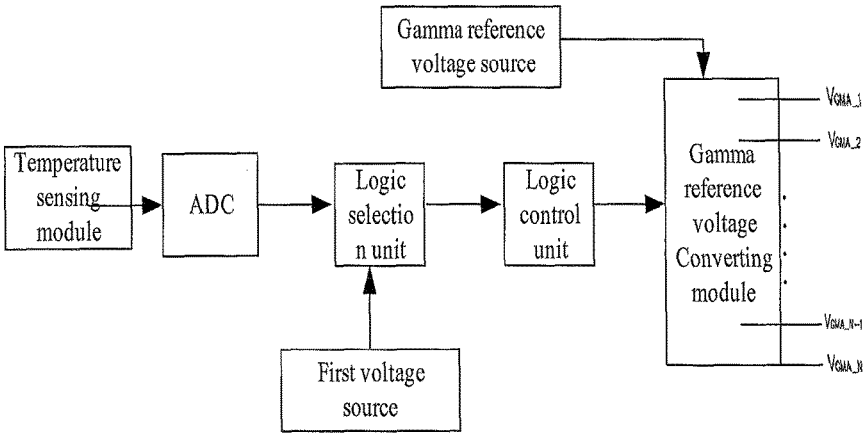
FIG. 4 is a schematic diagram of a circuit structure of a Gamma reference voltage generating device according to a second embodiment of the present disclosure.

FIG. 4 schematically illustrates the circuit structure of a Gamma reference voltage generating device according to a second embodiment of the present disclosure. As shown in FIG. 4, in the Gamma reference voltage generating device of the embodiment, the selection output module can comprise an analog-to-digital converting unit, a logic selection unit and a logic control unit. The temperature sensing unit is configured to convert the temperature signal into an electrical signal (analog quantity) and is connected to the analog-to-digital converting unit. The analog-to-digital converting unit is configured to convert the electric signal from the temperature sensing unit into a digital quantity, and is connected to the logic selection unit. The logic selection unit is electrically connected to the logic control unit and configured to adjust the first voltage provided by the first voltage source according to the digital quantity from the analog-to-digital converting unit to determine the magnitude of the voltage input to the logic control unit. The logic control unit is configured to output a stable voltage to compensate for the respective Gamma reference voltages.

Figure 5:
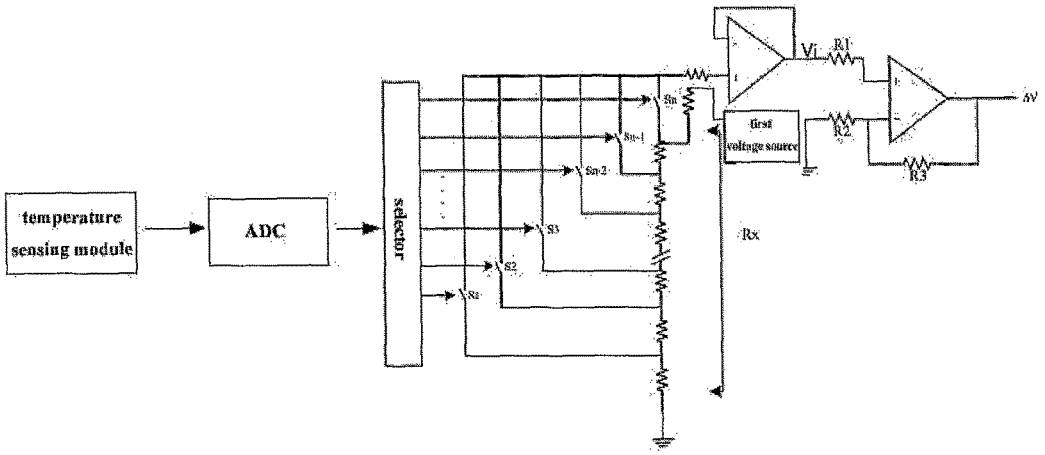
FIG. 5 is a schematic diagram of a circuit structure of the voltage temperature compensation circuit according to the first and second embodiments of the present disclosure.

FIG. 5 schematically illustrates the voltage temperature compensation circuit in the first and the second embodiments of the present disclosure. As shown in FIG. 5, in the voltage temperature compensation circuit, the logic selection unit can comprise a selector and a Rx resistor network.

The Rx resistor network is connected to the first voltage source, the Rx resistor network comprises a bleeder circuit consisting of n resistors connected in series and n switch units, one terminal of the ith switch unit is connected to a bleeder node of the ith resistor, and the other terminal of each switch unit is connected to the logic control unit, where i is larger than 1 but smaller than n. The selector is configured to selectively turn on a switch unit of the Rx resistor network according to the digital signal output by the analog-to-digital converting unit. When the temperature changes, the selector selects one branch, and the Rx resistor network obtains some voltage of the first voltage source by voltage bleeding to compensate for the respective Gamma reference voltage signals. The n resistors connected in series can have the same resistance or different resistances.

For example, as shown in FIG. 5, the Rx resistor network comprises n switch units S1~Sn and n resistors, where n is an integer larger than 1. Specifically, when the temperature sensing module converts the sensed temperature signal into an electrical signal, the electrical signal is an analog quantity. The electrical signal can be a current signal or a voltage signal. In order to facilitate signal processing, the current signal is usually converted into a voltage signal, and then the analog-to-digital converting unit (ADC) converts the voltage signal which is an analog quantity into a binary digital quantity. At this time, the selector selects one branch of the n switch units S1~Sn to turn on according to the binary code, wherein the n switch units are corresponding to n resistors. Turning off any switch unit is corresponding to the output of one unique resistance value of resistor, i.e., corresponding to one temperature compensation voltage. In other words, with different temperatures, the resistance value loaded at this time is also different. Therefore, when different branches are gated, the voltage of the first voltage source obtained by voltage bleeding is also different, so that the compensation voltage for the Gamma reference voltages is also different for different temperatures. Therefore, the poor display due to different temperature changes can be alleviated. It should be noted that the selector and the Rx resistor network can be integrated in one chip to realize the function of logic selection.

The above describes the case that one resistor is directly connected between two switch units of the Rx resistor network; however, a plurality of resistors can also be connected between the two switch units.

Alternatively, the logic control unit can comprise an adder and a negative feedback amplifier. The positive input terminal of the adder receives the signal output by the logic selection unit, and the negative input terminal of the adder is connected to the output terminal of the adder.

The positive input terminal of the negative feedback amplifier is connected to the output terminal of the adder, the negative input terminal of the negative feedback amplifier is grounded, and the output terminal of the feedback amplifier outputs a voltage signal which has been subjected to temperature compensation. The logic control unit is equivalent to a follower. It can be understood by those skilled in the art that the function of the follower is to make the input voltage approximate the output voltage amplitude. In addition, the follower presents a high impedance state to the circuit in its previous stage and a low impedance state to the circuit in its following stage, and thus has an "isolation" effect for the circuits in the previous stage and the following stage. In other words, more stable voltage can be output by the follower. For example, the logic control unit in the embodiment comprises an adder and a negative feedback amplifier, wherein, as shown in FIG. 5, the resistors R1, R2 and R3 have the same resistance, then $\Delta V=Vi$, where $\Delta V$ is a compensation voltage value of a corresponding temperature and Vi is the voltage output by the logic selection unit. $\Delta V$ obtained through the logic control unit is more stable. It should be noted that, in the integrated circuit, the adder and the negative feedback amplifier in the logic control unit can be integrated in one chip.

Alternatively, the temperature sensing module comprises a temperature sensor and a temperature transmitter. The temperature sensor is configured to sense temperature and transfer the temperature signal to the temperature transmitter, and the temperature transmitter converts the temperature signal into the electrical signal. Of course, the temperature sensing module also comprises other elements for processing signals, whose description is omitted herein.

Alternatively, the Gamma reference voltage converting module comprises a resistance bleeder unit and multiple operational amplifiers. The resistance bleeder unit is coupled to the Gamma reference voltage source and has N bleeder points which provide N Gamma reference voltages respectively. Each bleeder point is connected to an operational amplifier. The electrical signal output by the temperature compensation circuit is input to the operational amplifiers. The operational amplifiers output Gamma reference voltages which have been subjected to temperature compensation.

Figure 6:
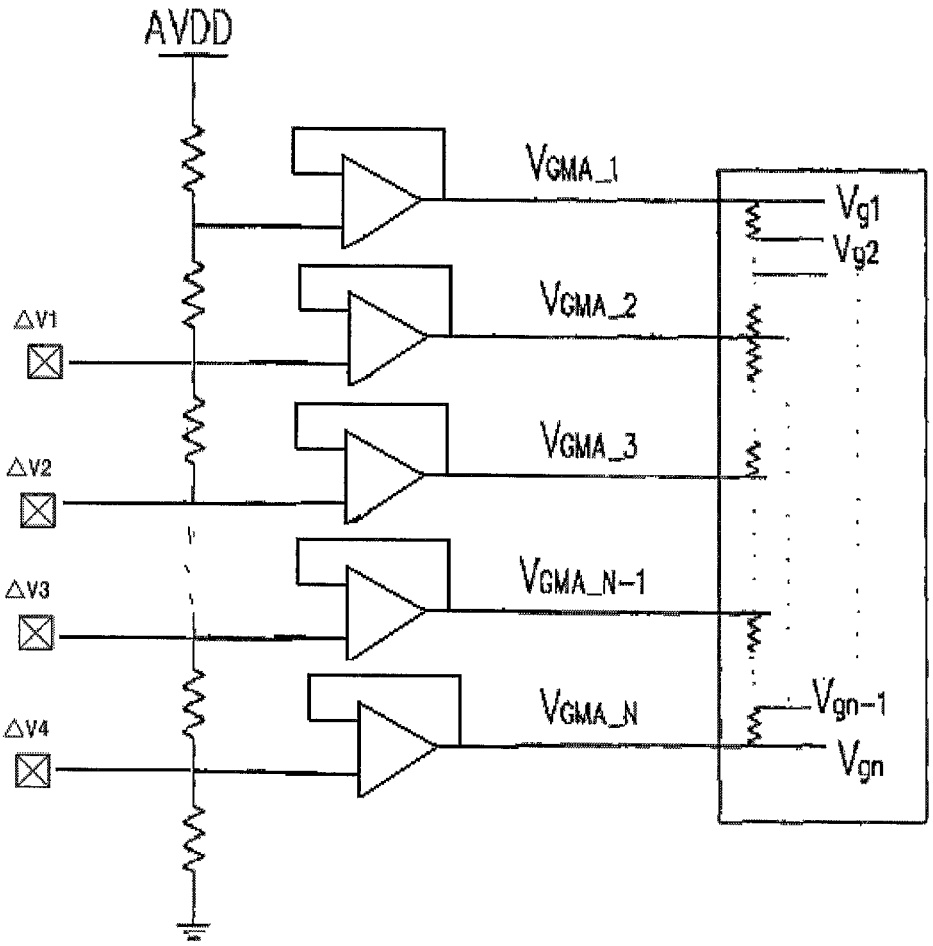
FIG. 6 is a schematic diagram of a Gamma reference voltage generating device at four compensation points according to an embodiment of the present disclosure.

In order to better understand the embodiment, the description is made by taking a Gamma reference voltage generating device comprising four temperature compensation points as an example in the following. FIG. 6 schematically illustrates the Gamma reference voltage generating device at the four compensation points in the embodiment. As shown in FIG. 6, four compensation points are selected and each compensation point is corresponding to one temperature compensation unit. Each temperature compensation unit outputs one compensation voltage $\Delta V$ according to the temperature change sensed by its temperature sensing module. The original Gamma reference voltage generating device (the Gamma reference voltage generating device without temperature compensation units) is voltage divided, and outputs a plurality of Gamma reference voltages. Now, the compensation voltage $\Delta V$ is connected to part of the compensation points to make the voltages at these compensation points be ΔV, like ΔV1, ΔV2, ΔV3, ΔV4 shown in FIG. 6. In addition, the voltage dividing state on the branch between two points and corresponding to the Gamma reference voltage also changes; therefore, the output of the Gamma reference voltages changes.

Figure 7:
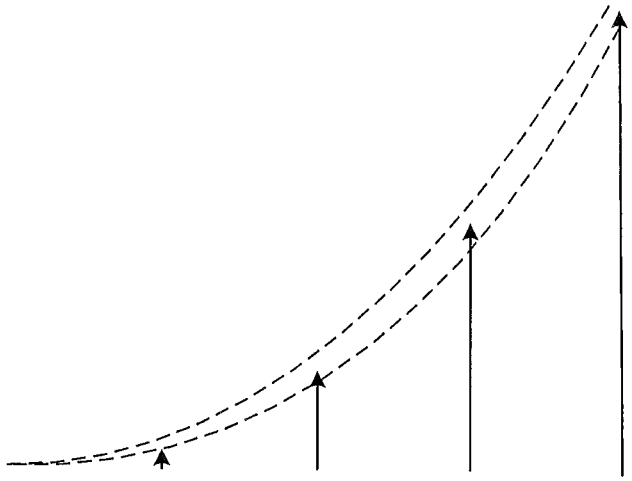
FIG. 7 is a diagram showing Gamma voltage curves of the Gamma reference voltage generating device at four compensation points according to an embodiment of the present disclosure.

FIG. 7 shows a diagram of Gamma voltage curves of the Gamma reference voltage generating device at four compensation points according to an embodiment of the present disclosure. As shown in FIG. 7, the coordinates in the Gamma curves are restored to the design values. Now, the display quality of the display can be restored to the operation state at the normal temperature.

In the embodiment, 4 compensation points for the Gamma voltage is taken as an example, but the number of compensation points is not limited to this. It can be increased or decreased as needed in practice, for example, 16 or 64 compensation points can be set. Taking 8 bit-256 gray scales as an example, 256 compensation points can be set at most in principle for each Gamma voltage. Obviously, the more compensation points there are, the more accurate the Gamma curve is, the less the influence of the temperature change on the displaying of the display, and the more and the more complicated the temperature compensation circuits are. If the displaying of the display is by 10 bits, then there are 1024 Gamma voltages, and the compensation points can be decreased likewise as needed.

Third Embodiment

The embodiment provides a display which can comprise a Gamma reference voltage generating device according to the first or the second embodiment and a gray scale voltage generating device connected thereto. The gray scale voltage generating device is configured to generate a plurality of gray scale voltages based on the Gamma reference voltages which have been subjected to temperature compensation, and the display displays gray scales using the gray scale voltages.

It should be noted that each of the Gamma reference voltages in the embodiment is corresponding to one Gamma reference voltage signal port in the Gamma reference voltage generating device.

Of course, the gray scale voltage device further comprises a gray scale voltage generating module which is connected to the Gamma voltage signal ports and configured to generate a plurality of gray scale voltages according to the Gamma voltages output by the Gamma voltage signal ports.

It should be noted that the gray scale voltage generating module is usually a source driving IC. Taking an 8 bit source driving IC as an example, the Gamma reference voltage source provides 8 Gamma reference voltages which are output to the source driving IC (the gray scale voltage generating module) through the Gamma voltage signal ports to generate 256 gray scale voltages. The gray scale voltage generating process is well-known by those skilled in the art, and will not be described in detail herein.

The display can be any product or means with display function, such as a cell phone, a tablet computer, a TV set, a display, a notebook computer, a digital photo frame, a navigator or the like.

The display in the embodiment has a Gamma reference voltage generating device in the first or the second embodiment; therefore it can avoid poor display due to temperature change.

Nevertheless, the display in the embodiment can further comprise other normal structures such as a display driving unit and so on.

It can be understood that the above implementations are only exemplary implementations adopted for explaining the principles of the present disclosure, but the present disclosure is not limited thereto. Those skilled in the art can make various modifications and improvements without departing from the spirit and essence of the present disclosure, and these modifications and improvements are also intended to fall within the protection scope of the present disclosure.

The present application claims the priority of Chinese Patent Application No. 201410040246.1 filed on Jan. 27, 2014, entire content of which is incorporated herein as part of the present application by reference.

What is claimed is:

1. A Gamma reference voltage generating device comprising: a Gamma reference voltage source and a Gamma reference voltage converting circuit, the Gamma reference voltage source being connected to the Gamma reference voltage converting circuit and configured to provide Gamma reference voltages, wherein the Gamma reference voltage generating device further comprises at least one temperature compensation circuit which is connected to the Gamma reference voltage converting circuit and configured to automatically adjust output voltages according to temperature change to compensate the Gamma reference voltages output by the Gamma reference voltage source through the Gamma reference voltage converting circuit, wherein the temperature compensation circuit comprises a temperature sensing circuit, a selection output circuit and a first voltage source;

the temperature sensing circuit is configured to convert a temperature signal into an electrical signal;

the first voltage source is connected to the selection output circuit and configured to provide first voltages to the selection output circuit; and the selection output circuit is connected to the temperature sensing circuit and configured to selectively output a compensation voltage from the first voltages input by the first voltage source according to the electrical signal from the temperature sensing circuit, wherein the Gamma reference voltage converting circuit comprises a resistance divider coupled to the Gamma reference voltage source and having a plurality of resistors connected in series, the resistance divider has N voltage division points arranged between any two adjacent resistors of the plurality of resistors respectively, at least one voltage division point among the N voltage division points is selected as a compensation point, and the compensation point is configured to receive the compensation voltage outputted from the at least one temperature compensation circuit and a voltage of the Gamma reference voltage source distributed at the compensation point.

2. The Gamma reference voltage generating device according to claim 1, wherein the selection output circuit comprises an analog-to-digital converting circuit, a logic selection circuit and a logic control circuit;

the analog-to-digital converting circuit is configured to convert the electric signal from the temperature sensing circuit into a digital signal;

the logic selection circuit is configured to select the compensation voltage input to the logic control circuit according to the digital signal from the analog-to-digital converting circuit; and the logic control circuit is configured to output a stable compensation voltage to compensate for the Gamma reference voltages.

3. The Gamma reference voltage generating device according to claim 2, wherein the logic selection circuit comprises a selector and a Rx resistor network;

the Rx resistor network is connected to the first voltage source, the Rx resistor network comprises a bleeder circuit consisting of n resistors connected in series and n switch circuits, one terminal of the ith switch circuit is connected to the bleeder node of the ith resistor, and the other terminal of each switch circuit is connected to the logic control circuit, where i is larger than 1 but smaller than n; and the selector is configured to selectively turn on a switch circuit of the Rx resistor network according to the digital signal output by the analog-to-digital converting circuit.

4. The Gamma reference voltage generating device according to claim 3, wherein the logic control circuit comprises an adder and a negative feedback amplifier;

the positive input terminal of the adder receives the signal output by the logic selection circuit, and the negative input terminal of the adder is connected to the output terminal of the adder; and the positive input terminal of the negative feedback amplifier is connected to the output terminal of the adder, the negative input terminal of the negative feedback amplifier is grounded, and the output terminal of the feedback amplifier outputs a voltage signal which has been subjected to temperature compensation.

5. The Gamma reference voltage generating device according to claim 3, wherein the Gamma reference voltage converting circuit further comprises a plurality of operational amplifiers; and the plurality of operational amplifiers are connected to the N voltage division points respectively, and the plurality of operational amplifiers are configured to output Gamma reference voltages which have been subjected to temperature compensation.

6. The Gamma reference voltage generating device according to claim 2, wherein the logic control circuit comprises an adder and a negative feedback amplifier;

the positive input terminal of the adder receives the signal output by the logic selection circuit, and the negative input terminal of the adder is connected to the output terminal of the adder; and the positive input terminal of the negative feedback amplifier is connected to the output terminal of the adder, the negative input terminal of the negative feedback amplifier is grounded, and the output terminal of the feedback amplifier outputs a voltage signal which has been subjected to temperature compensation.

7. The Gamma reference voltage generating device according to claim 6, wherein the Gamma reference voltage converting circuit further comprises a plurality of operational amplifiers; and the plurality of operational amplifiers are connected to the N voltage division points respectively, and the plurality of operational amplifiers are configured to output Gamma reference voltages which have been subjected to temperature compensation.

8. The Gamma reference voltage generating device according to claim 2, wherein the temperature sensing circuit comprises a temperature sensor and a temperature transmitter; and the temperature sensor is configured to sense temperature and transfer the temperature signal to the temperature transmitter, and the temperature transmitter converts the temperature signal into the electrical signal.

9. The Gamma reference voltage generating device according to claim 2, wherein the Gamma reference voltage converting circuit further comprises a plurality of operational amplifiers; and the plurality of operational amplifiers are connected to the N voltage division points respectively, and the plurality of operational amplifiers are configured to output Gamma reference voltages which have been subjected to temperature compensation.

10. The Gamma reference voltage generating device according to claim 1, wherein the temperature sensing circuit comprises a temperature sensor and a temperature transmitter; and the temperature sensor is configured to sense temperature and transfer the temperature signal to the temperature transmitter, and the temperature transmitter converts the temperature signal into the electrical signal.

11. The Gamma reference voltage generating device according to claim 1, wherein the Gamma reference voltage converting circuit further comprises a plurality of operational amplifiers; and the plurality of operational amplifiers are connected to the N voltage division points respectively, and the plurality of operational amplifiers are configured to output Gamma reference voltages which have been subjected to temperature compensation.

12. A display comprising a Gamma reference voltage generating device according to claim 1 and a gray scale voltage generating device connected thereto, wherein the gray scale voltage generating device is configured to generate a plurality of gray scale voltages based on the Gamma reference voltages which have been subjected to temperature compensation, and the display displays gray scales using the gray scale voltages.

13. The display according to claim 12, wherein the selection output circuit comprises an analog-to-digital converting circuit, a logic selection circuit and a logic control circuit;

the analog-to-digital converting circuit is configured to convert the electric signal from the temperature sensing circuit into a digital signal;

the logic selection circuit is configured to select the compensation voltage input to the logic control circuit according to the digital signal from the analog-to-digital converting circuit; and the logic control circuit is configured to output a stable compensation voltage to compensate for the Gamma reference voltages.

14. The display according to claim 13, wherein the logic selection circuit comprises a selector and a Rx resistor network;

the Rx resistor network is connected to the first voltage source, the Rx resistor network comprises a bleeder circuit consisting of n resistors connected in series and n switch circuits, one terminal of the ith switch circuit is connected to the bleeder node of the ith resistor, and the other terminal of each switch circuit is connected to the logic control circuit, where i is larger than 1 but smaller than n; and the selector is configured to selectively turn on a switch circuit of the Rx resistor network according to the digital signal output by the analog-to-digital converting circuit.

15. The display according to claim 13, wherein the logic control circuit comprises an adder and a negative feedback amplifier;

the positive input terminal of the adder receives the signal output by the logic selection circuit, and the negative input terminal of the adder is connected to the output terminal of the adder; and the positive input terminal of the negative feedback amplifier is connected to the output terminal of the adder, the negative input terminal of the negative feedback amplifier is grounded, and the output terminal of the feedback amplifier outputs a voltage signal which has been subjected to temperature compensation.

16. The display according to claim 12, wherein the temperature sensing circuit comprises a temperature sensor and a temperature transmitter; and the temperature sensor is configured to sense temperature and transfer the temperature signal to the temperature transmitter, and the temperature transmitter converts the temperature signal into the electrical signal.

17. The display according to claim 12, wherein the Gamma reference voltage converting circuit further comprises a plurality of operational amplifiers; and the plurality of operational amplifiers are connected to the N voltage division points respectively, and the plurality of operational amplifiers are configured to output Gamma reference voltages which have been subjected to temperature compensation.

18. The Gamma reference voltage generating device according to claim 1, wherein the Gamma reference voltage converting circuit further comprises a plurality of operational amplifiers; and the plurality of operational amplifiers are connected to the N voltage division points respectively, and the plurality of operational amplifiers are configured to output Gamma reference voltages which have been subjected to temperature compensation.

* * * * *